United States Patent [19]

Elias et al.

[11] 4,007,667

[45] Feb. 15, 1977

[54] HYDRAULIC POSITIONING AND SHOCK-ABSORBING APPARATUS

[75] Inventors: Jacob K. Elias; Victor G. Eriksen, both of Campbell River, Canada

[73] Assignee: Fauchon Engineering Works Limited, Campbell River, Canada

[22] Filed: Aug. 15, 1975

[21] Appl. No.: 605,169

[52] U.S. Cl. ..... 92/60; 60/371; 188/313

[51] Int. Cl.[2] ..... F01B 31/14

[58] Field of Search ..... 92/60, 75, 162 R, 162 P; 91/440; 60/371, 543, 592, 572; 188/279, 297, 313

[56] References Cited

UNITED STATES PATENTS

| | | | |
|---|---|---|---|
| 2,525,021 | 10/1950 | Douglas | 60/371 |
| 2,780,204 | 2/1957 | Barley | 92/60 |
| 2,862,360 | 12/1958 | Audemar | 92/60 |
| 3,029,904 | 4/1962 | Goldring | 188/313 |
| 3,255,850 | 6/1966 | Gray | 188/313 |
| 3,293,994 | 12/1966 | Napolitano | 92/60 |
| 3,385,169 | 5/1968 | Hale | 92/60 |
| 3,532,029 | 10/1970 | Roschupkin | 92/60 |
| 3,780,621 | 12/1973 | Romell | 60/371 |
| 3,803,840 | 4/1974 | Toczycki | 60/371 |
| 3,814,194 | 6/1974 | Reich | 92/75 |

*Primary Examiner*—Martin P. Schwadron
*Assistant Examiner*—Abraham Hershkovitz
*Attorney, Agent, or Firm*—Fetherstonhaugh & Co.

[57] ABSTRACT

Apparatus having an operating cylinder and piston rod combined with a shock-absorbing cylinder and piston. The two hydraulic devices are connected by a conduit which allows the piston rod of the operating cylinder to yield under shock loads which are absorbed by the second cylinder and piston and immediately return to an original adjusted position when any imposed load returns to normal.

3 Claims, 3 Drawing Figures

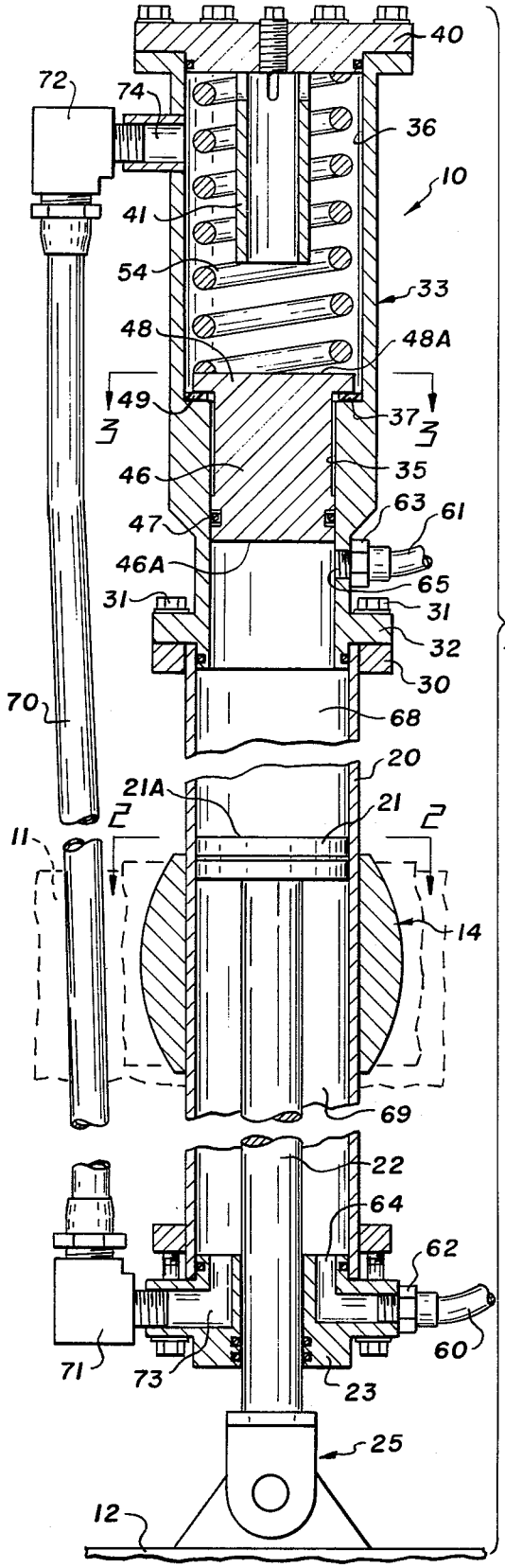
Fig. 1.
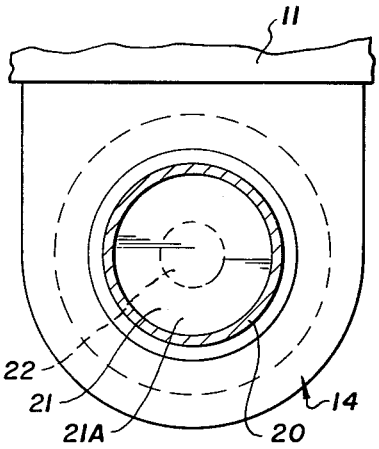
Fig. 2.
Fig. 3.
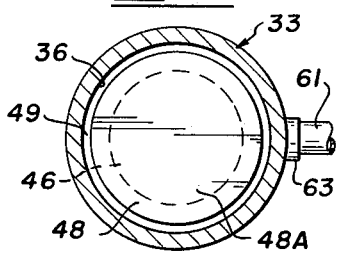

HYDRAULIC POSITIONING AND SHOCK-ABSORBING APPARATUS

This invention relates to hydraulic apparatus for holding a machine part in an adjusted position while affording protection against shock forces.

There are a number of machines such as bulldozers and other earth-moving equipment which employ hydraulic means for moving a part to a selected position with respect to its work and, during the course of normal operations, the work may impose varying loads on that part. For example, a road grader is fitted with a heavily constructed blade which is pivotally mounted on the machine with the blade being angled as required by a hydraulic cylinder arrangement. When the blade is advanced along the roadbed during the grading operation, projecting rocks and the like struck by the blade will impose an undesirable strain on both the machine and the driver if steps are not taken to absorb some of the shocks. This generally requires the use of spring mountings and other cushioning devices all of which add to the cost of buying and maintaining the machine.

The present invention overcomes the above as well as other disadvantages of related equipment by providing apparatus which is a combination of a hydraulic working cylinder and a mechanical-hydraulic shock absorber. The assembly is included in the hydraulic system of the road grader and is operable by the driver without the need for additional control valves etc. since the shock-absorbing action automatically returns the working cylinder to any position to which it has been adjusted by the driver.

More specifically, a hydraulic positioning and shock-absorbing apparatus according to the present invention may be defined as comprising a main cylinder having a piston and a piston rod therefor, said piston normally being located intermediate opposite ends of the main cylinder to divide the interior of said cylinder into rod and head chambers, fluid circuit means separately connecting the rod and head chamber to a source of fluid pressure whereby the piston rod can be extended or retracted as required to locate and hold the machine part in a selected position, an auxiliary cylinder having a piston, spring means biasing the last mentioned piston in one direction, a conduit connecting the interior of the auxiliary cylinder to the rod chamber, and fluid conducting means interconnecting the main and auxiliary cylinder allowing pressurized fluid developed within the head chamber to exert pressure on the piston of said auxiliary cylinder in opposition to the force applied by the spring means.

In the drawings which illustrate a preferred embodiment of the invention:

FIG. 1 is a fragmentary vertical section of hydraulic positioning and shock-absorbing apparatus constructed in accordance with the present invention, FIG. 2 is a transverse section taken on the line 2—2 of FIG. 1, and FIG. 3 is a transverse section taken on the line 3—3 of FIG. 1.

Referring to the drawings, the numeral 10 indicates generally hydraulic positioning and shock-absorbing apparatus constructed in accordance with the present invention. The apparatus 10 is shown in the position it would assume if mounted on a longitudinal frame member 11 of a road grader fitted with a scraper blade 12. A bracket or other suitable mounting generally indicated at 14 is shown securing the apparatus 10 to frame member 11 of the machine so that the blade 12 can be raised and lowered as required to level the surface of a road or other area with the blade simultaneously being protected from heavy shock loads which would otherwise be transmitted to the machine and the operator.

In FIG. 1, the apparatus 10 is shown in greater detail as comprising a main cylinder 20 which may be close to four feet in length when the present apparatus is installed on a road grader. Cylinder 20 is fitted with a piston 21 having a rod 22. A suitably sealed bearing 23 is provided on the lower end of the cylinder 20 to slidably and rotatably support the piston rod. The projecting end of the rod 22 is attached to the blade 12 by a pivotal connection generally indicated at 25.

The upper end of the main cylinder 20 has a top flange 30 which is secured by cap screws 31 to a similar flange 32 welded or otherwise secured to the lower end of an auxiliary cylinder generally indicated at 33. The cylinder 33, which is considerably shorter than the main cylinder, has a bore 35 and a relatively large-diameter chamber 36. A shoulder 37 is defined between the chamber and the bore of the cylinder 33. The upper end of the cylinder 33 is fitted with a cap 40 and depending from this end cap is a tubular stop 41 which is concentric with respect to the auxiliary cylinder. Within the auxiliary cylinder 33 there is a piston 46 fitted with an O-ring 47 and having a end flange 48. A washer 49, preferably of a synthetic material such as nylon, is interposed between the shoulder 37 and the end flange 48. A strong compression spring 54 is mounted between the end cap 40 of the auxiliary cylinder and the piston 46. This spring holds the piston 46 firmly in contact with the washer 49 which is seated on the shoulder 37.

The hydraulic positioning and shock-absorbing apparatus 10 is connected into the hydraulic system of the road grader by circuit means which includes a control valve (not shown) for operation by the driver of the road grader. Hoses 60 and 61 are also included in this circuit and fittings 62 and 63 respectively connect these hoses to inlet-outlet ports 64 and 65 provided in opposite ends of the lower end bearing 23 of the main cylinder and in the cylinder 33 below the piston 46. The piston 21 divides the interior of the main cylinder 20 into a head chamber 68 and a rod chamber 69 and the hoses 60 and 61 supply pressurized oil to the two chambers to extend and retract the piston rod 22.

The rod chamber 69 of the main cylinder and the chamber 36 of the auxiliary cylinder are in communication with one another through a conduit such as a flexible hose 70. This condiut 70 is attached to the two cylinders by fittings 71 and 72 whereby to connect with inlet-outlet ports 73 and 74.

In operation, the driver of the road grader operates his control valve to feed oil under suitable pressure into the chamber 68 and this extends the rod 22 to lower the blade 12 onto the road surface. Oil under suitable pressure is maintained in the rod chamber 69 as well to hold the piston 21 and therefore the scraper blade 12 in a selected position and this oil also reaches the chamber 36 through the hose 70. Thus, both the main and auxiliary cylinders of the apparatus 10 are charged with oil and the scraper blade is positioned and held as required for a particular scraping operation.

Should the blade 12 strike a rock, for example, the piston 21 will be driven a short distance upwardly into the chamber 68 to increase oil pressure within that chamber. This oil acts on the underside of the piston 46 to raise the piston slightly against the pressure exerted by the spring 54 and normal fluid pressure within the chamber 36 of the auxiliary cylinder. Upward movement of the piston 46 discharges oil from the chamber 36 through the conduit 70 into the rod chamber 69 which allows the piston 21 to move upwardly as previously described. As soon as the obstruction is cleared, the apparatus 10 returns to its original set position and the scraper blade 12 is reapplied to the road surface at the same height and pressure as before.

It will be noticed that the effective area 21A of the piston 21 is greater than the effective area 46A of the piston 46. The effective area 48A of the top flange 48 is slightly larger than area 46A and the spring 54 also exerts a force tending to hold the piston 46 against upward movement. Thus, a balance is achieved between the several fluid pressures and the spring pressure which enables the main cylinder to function normally while providing a shock-absorbing action particularly well suited for heavy earthmoving equipment and the like.

It is the difference between the areas 21A and 46A plus the strength of the spring 54 which determines the extent of the shock load required to cause the apparatus 10 to function as a shock absorber as distinct from an operating cylinder serving to apply the scraper blade to the road surface. The amount of oil which is displaced from the chamber 36 is equal to the further amount which is required within the chamber 69 to allow the piston 21 to move upwardly in response to shock loads without imposing undue strain upon the seals and the like of the end bearing 23. A limit is set to the extent of upward movement of the piston 46 in the cylinder 33 by the tubular stop 41 and this prevents excessive telescoping of the apparatus 10 which might cause damage to some of its working parts or to parts of the grader.

From the foregoing, it will be apparent there is provided apparatus which combines a normal working hydraulic device with a mechanical-hydraulic shock absorber. The combination enables a machine part to be positioned as required without the need for the machine operator to concern himself about relocating the part after it is shifted out of position by a shock force imposed thereon. The piston of the working cylinder gives way under overload conditions and is automatically returned to set position once the overload is removed.

We claim:

1. Apparatus for positioning a machine part subject to shock loads comprising a main cylinder having a piston and a piston rod therefor, said piston dividing the main cylinder into a head chamber and a rod chamber, fluid circuit means separately connecting the head and rod chambers to a source of fluid pressure whereby the piston rod can be extended or retracted as required to locate and hold the machine part in a selected position, an auxiliary cylinder having a through bore open to the head chamber and a shoulder between said through bore and a chamber within said auxiliary cylinder, a piston in the through bore and having an end flange in the auxiliary cylinder, a compression spring within the auxiliary cylinder chamber biasing the piston thereof towards the main cylinder and normally abutting the end flange against the shoulder, and a conduit connecting the rod chamber to the auxiliary cylinder chamber.

2. Apparatus as claimed in claim 1, in which the pistons of the main and auxiliary cylinders have effective areas opposing one another, the effective area of the former piston being greater than the corresponding area of the latter piston.

3. Apparatus as claimed in claim 2, and including a stop mounted in the auxiliary cylinder in spaced relation to the end flange of the piston therein.

* * * * *